US005836210A

United States Patent [19]

Lohausen

[11] Patent Number: 5,836,210

[45] Date of Patent: Nov. 17, 1998

[54] ARM BEARING FOR AN AWNING

[75] Inventor: Viktor Lohausen, 74199 Oberheinriet, Germany

[73] Assignee: Technolizenz Establishment, Triesen, Liechtenstein

[21] Appl. No.: 605,229

[22] Filed: Nov. 28, 1995

[30] Foreign Application Priority Data

May 28, 1993 [CH] Switzerland ..... 01611/93

[51] Int. Cl.[6] ..... G05G 11/00

[52] U.S. Cl. ..... 74/483 K; 403/95; 403/87; 248/231.31; 248/222.13

[58] Field of Search ..... 74/483 K; 248/231.31, 248/222.13, 222.51; 403/95, 87, 84

[56] References Cited

U.S. PATENT DOCUMENTS

| | | | |
|---|---|---|---|
| 2,271,332 | 1/1942 | Ellington | 74/483 K |
| 2,798,468 | 7/1957 | Heidner | 74/483 K |
| 4,096,765 | 6/1978 | Cochran | 74/483 K |
| 4,577,986 | 3/1986 | Wang | 403/95 |
| 4,602,889 | 7/1986 | Mu-Shan | 403/95 |
| 5,310,145 | 5/1994 | Chen | 403/84 |

FOREIGN PATENT DOCUMENTS 55-99621 7/1980 Japan .

*Primary Examiner*—Charles A. Marmor
*Assistant Examiner*—David M. Fenstermacher

[57] ABSTRACT

An arm bearing for an awning has at least one support block, at least one bearing block arranged to swivel about a first rotation axle into a drop-out position, and an arm rotatable about a second rotation axle transversely to said first rotation axle. A threaded coupling rod couples the support block and the bearing block for tilting movement of the bearing block. An adjustable nut is coupled to the threaded coupling rod for limiting the tilting movement of the bearing block within variable limits. At least one lock is coupled to the arm and is transversely displaceable to the threaded coupling rod for locking engagement with the adjusting nut. The adjusting nut has at least one recess or projection arranged approximately radially with respect to the threaded coupling rod for locking engagement with the lock. An eccentric cam is rigidly connected to the arm for positively controlling displacement of the lock.

14 Claims, 3 Drawing Sheets

ARM BEARING FOR AN AWNING

This is a Continuation-In-Part of International Application PCT/EP 94/01742 with an International filing date of May 28, 1994, now abandoned.

BACKGROUND OF THE INVENTION

1. Field of the Invention

This invention relates to an arm bearing for an awning, and more particularly, to an arm bearing that is used where it is intended to adjust the inclination of the awning. Since components used for this purpose are always subjected to high loads, they must be produced from high quality, expensive materials.

2. Summary of the Invention

The object of the invention is to provide an awning arm bearing that uses as few components as possible. The components should be as small as possible, and arranged to avoid unnecessary wear. Moreover, the guides and locking devices of the arm bearing should engage and grip with the other arm bearing components positively and without play.

This object is achieved by an awning arm bearing having at least one support block, at least one bearing block arranged to swivel about a first rotation axle into a drop-out position, and an arm rotatable about a second rotation axle transversely to the first rotation axle. A threaded coupling rod couples the support block and the bearing block for tilting movement of the bearing block. An adjustable nut is coupled to the threaded coupling rod for limiting the tilting movement of the bearing block within variable limits. At least one lock is coupled to the arm and is displaceable transversely to the threaded coupling rod for locking engagement with the adjusting nut. The adjusting nut has at least one recess or projection arranged approximately radially with respect to the threaded coupling rod for locking engagement with the lock. And, an eccentric cam is rigidly connected to the arm for positively controlling displacement of the lock.

The term "adjusting nut" is to be understood as meaning any component (for example, a component having a spherical, cylindrical or prismatic shape) that has a threaded hole for engaging a thread on the coupling rod. For the purposes of the invention, it is possible to mount the coupling rod so that it is rotatable or to ensure that the adjusting nut is rotatable, and that both the coupling rod and the adjusting nut are rotatable absolutely and relative to each other.

Particular embodiments of the invention give rise to the following additional advantages:

The lock has at least two pins arranged to engage with at least two recesses spaced apart on each side of the projection on the adjusting nut. This feature permits distribution of the locking forces and a certain torque uptake, if required.

The lock has a conical contact surface for locking engagement with an approximately complementary surface on the adjusting nut. This ensures particularly easy insertion of the lock and play-free locking. The lock, the pins, the recesses and the adjusting nut have an approximately cylindrical shape. These components can be produced in an economical manner.

At least one bearing block is u-shaped and receives the threaded coupling rod between the limbs of the u-shaped bearing block. At least one of the limbs has a through-hole aligned with the recess in the adjusting nut when in a locking position to guide the lock into locking engagement with the adjusting nut. This feature provides a compact design and good force absorption in the bearing block.

The eccentric cam is formed on a beaded edge of a cam plate and the lock has a groove engaging with this beaded edge. This feature can be produced in a simple manner, for example, the cam may be produced or shaped by punching in a single operation.

A rotation preventer is provided to prevent the adjusting nut from rotating. The rotation preventer is a spring clip and a stop wall located inside at least one limb of the bearing block. The spring clip is held on the first rotation axle of the bearing block, or by means of weights counter-balancing the gravitational force. The rotation preventer can also be a chain or a wire, or the like.

A hollow mounting tube has a sliding block that slides within the hollow mounting tube. The support block is in two parts, fixed to the sliding block by screws. Each of the two parts of the support block is prevented from rotating by a groove that cooperates with a spring that is connected to the hollow mounting tube. These features increase the stability of the entire awning and increase accuracy in positioning the awning.

A toothed gear having a gear input shaft is connected to a rotary drive for adjusting the position of the threaded coupling rod relative to the adjusting nut by remote control. The threaded coupling rod is connected to the toothed gear at the end of the threaded coupling rod that faces away from the adjusting nut. These features increase the user friendliness of an awning having an arm bearing according to the invention.

The adjusting nut and the lock are made of hardened steel. The lock is arranged to penetrate between 5 to 10 mm. into the recess in the adjusting nut. It was determined that this feature provides advantages dimensions.

In addition to use in a wide variety of conventional awnings, the arm bearing according to the invention can also be used in tilt limiters for windows and the like.

BRIEF DESCRIPTION OF THE DRAWINGS

The present invention will now be described in detail, taken together with the drawings, in which.

DETAILED DESCRIPTION OF PREFERRED EMBODIMENTS

The figures are described in relation to one another. The same reference symbols denote identical components. Similar components bear the same reference symbols with different lower case letters.

Figure 1:
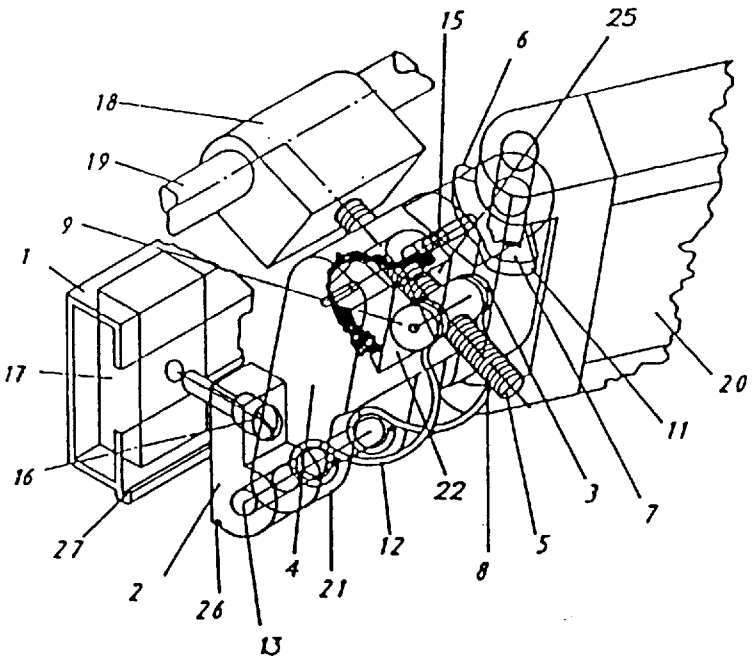
FIG. 1 shows a perspective view of an arm bearing according to the invention, having a loosened adjusting nut.

A hollow mounting tube (1) carries a two-part support block (2*a*, 2*b*). Only part 2*a* is shown in FIG. 1. By means of sliding block (17) and screw (16), the support block (2*a*) has, on its lower surface, a groove (26) that is additionally supported by engaging a spring (27) of the mounting tube (1). This feature is preferred but not essential. Among other things, the groove and spring serve to prevent the support block (2) from rotating.

The support block (2) receives an axle (3) on which a fork-shaped or u-shaped bearing block is rotatably mounted with its two fork prongs (4*a*, 4*b*). A spring clip (12) which serves to prevent an adjusting nut (9) from rotating is also arranged between the prongs (4*a*, 4*b*) and limb (21). The spring clip (12) could be replaced by other components. It is not essential for the bearing block to be fork-shaped. Support block (2) and bearing block (4) could also be formed in the converse manner, so that the support block is fork-shaped.

In its upper region, the bearing block (4) has a recess (22) that serves to receive the adjusting nut (9) if the latter is swiveled against the bearing block (4), or vice versa. In the region of the recess (22), the bearing block (4) has two holes. On one hand, which carries the adjusting nut (9) passes through at least one of the holes. On the other hand, a lateral hole serves to receive a pin-like lock that can be locked with the adjusting nut (9) because the latter has a corresponding lateral hole.

The coupling rod (5) is provided with a thread, and its end facing away from the adjusting nut (9) is connected to a gear housing (18), in particular, for holding a toothed gear which permits remote adjustment of the thread (8), and hence, the position of the adjusting nut (9) relative to the gear (18). This embodiment is preferred only because instead of the gear which also is held on the mounting tube (1), it is possible to provide only a rocker bearing point for the coupling rod (5). Remote adjustment is then impossible. In such a case, a screw slot indicated in FIG. 1 serves to adjust the thread (8) in the adjusting nut (9).

When the awning is opened, the bearing block (4) swivels forward until the adjusting nut (9) blocks the path of the bearing block (4). An articulated arm (20), which also swivels forward when the awning is opened, is rotatably mounted laterally on the bearing block (4). The articulated arm (20) is connected to a cam or cam plate that engages the lock (15). The cam is formed in such a way that the lock is pushed into its locked position when the arm (20) is swiveled fully out. The adjusting nut (9) is thus locked in the bearing block (4). The latter is thus fixed at a rigid distance from the gear (18) and hence, from the mounting tube (1). Any undesirable upward movement of the awning, for example, as a result of a gust of wind, is reliably avoided. Since the recess (22) can be made to fit exactly, the adjusting nut (9) is also held firmly without play and prevented from rotating.

Figure 2:
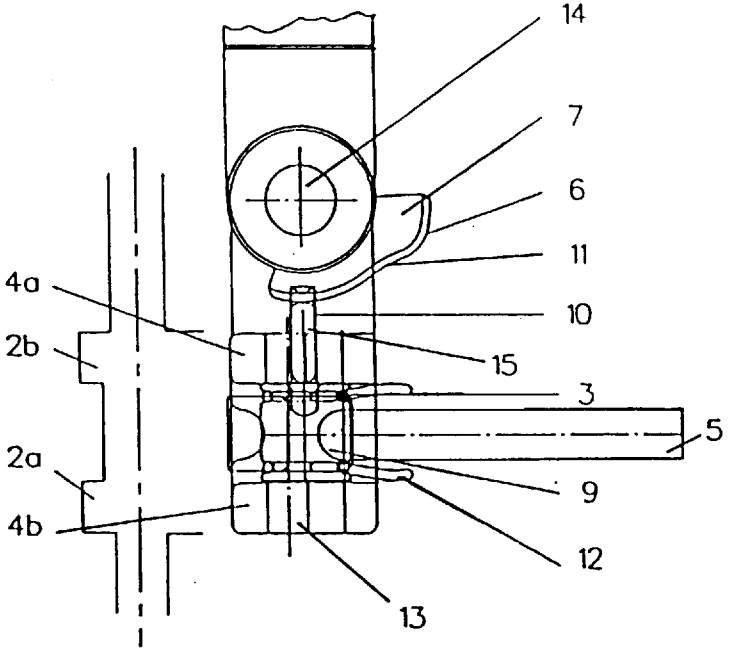
FIG. 2 shows a view from above with a released lock.
Figure 4:
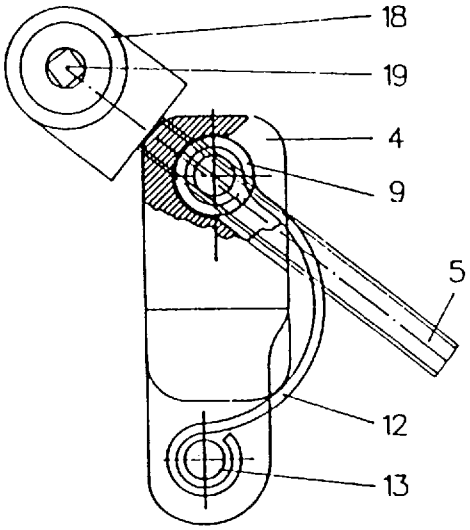
FIG. 4 shows a side view of the embodiment of FIG. 2.
Figure 3:
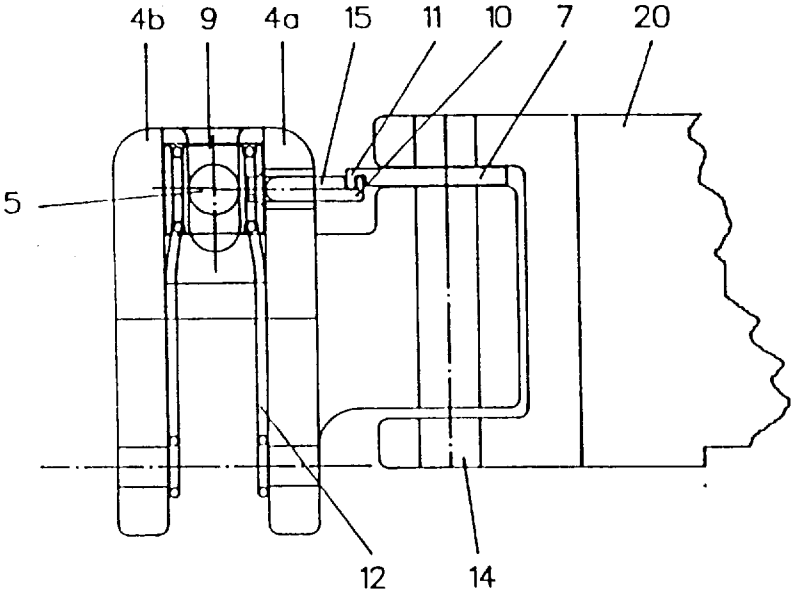
FIG. 3 shows a front view of the embodiment of FIG. 2.

FIGS. 2, 3 and 4 show the locking mechanism more clearly. The cam (6) is formed on a punched cam plate (7) that is arranged like a washer on the axle (14) between the articulated arm (20) and the bearing block (4). However, it is non-rotatably connected to the articulated arm (20). Cam (6) engages corresponding groove (10) in the lock (15). Thus, it is capable of pushing the latter laterally into the recess (3) in the adjusting nut (9). The cam (6) is correspondingly formed at the edge (11). This embodiment provides a particularly compact design.

Figure 7:
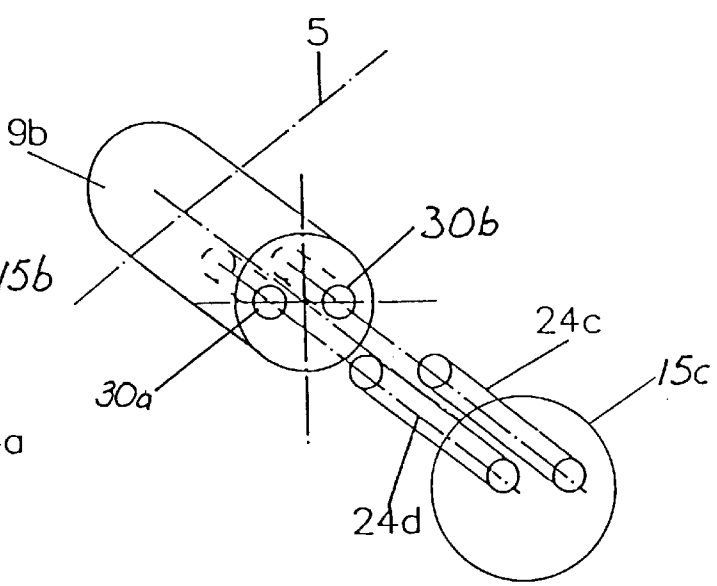
FIG. 7 shows a fourth embodiment of the lock and adjusting nut according to the present invention.
Figure 6:
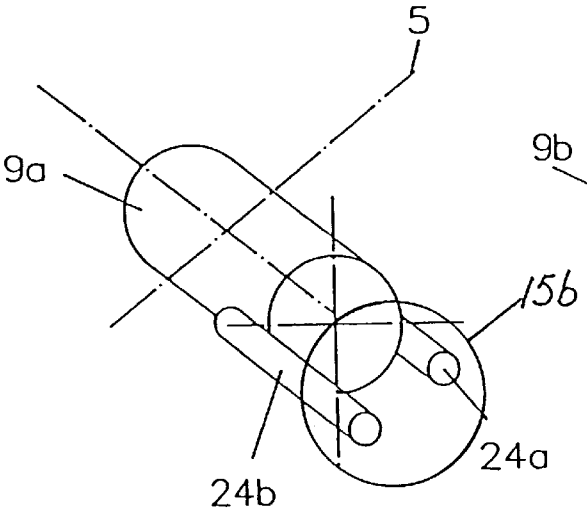
FIG. 6 shows a third embodiment of the lock and the adjusting nut according to the present invention.
Figure 5:
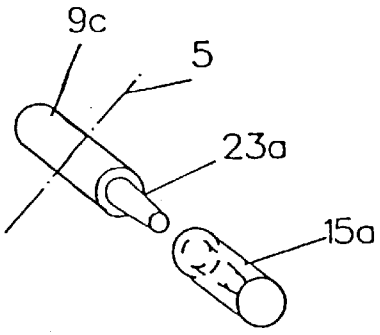
FIG. 5 shows a second embodiment of the lock and adjusting nut according to the present invention.

A particularly advantageous lock and adjusting nut embodiment is shown in FIG. 5. The lock (15*a*) is not in the form of a pin. Rather, it is in the form of a sleeve having a conical hole that cooperates with a diametrically opposite projection (23*a*) on the adjusting nut (9*c*). The axis of the coupling rod is indicated by the axis line (5*a*). In this design, the safety and reliability of the connection between the lock (15*a*) and the adjusting nut (9*c*) is increased. Converse technical solutions, i.e., with a conical hole in the adjusting nut (9*c*) and a conical projection on the lock (15*a*) are also possible. FIGS. 6 and 7 show lock (15*b*) and lock (15*c*), respectively. The axis of the coupling rod (5) is indicated by the axis line (5*a*). Referring to FIG. 6, the lock (15*b*) has pins (24*a*, 24*b*), which grip the adjusting nut (9*a*) laterally. Referring to FIG. 7, the lock (15*c*) has pins (24*c*, 24*d*), which engage holes (30*a*, 30*b*) in the adjusting nut (9*b*).

I claim:

1. An arm bearing for an awning, comprising:

at least one support block (2), at least one bearing block (4) arranged to swivel about a first rotation axle (13) into a drop-out position, an arm (20) rotatable about a second rotation axle (14) transversely to said first rotation axle (13), a threaded coupling rod (5) coupling said support block (2) and said bearing block (4) for tilting movement of said bearing block (4), an adjusting nut (9) coupled to said threaded coupling rod (5) for limiting said tilting movement of said bearing block (4) within variable limits, at least one lock (15) coupled to said arm (20) and displaceable transversely to said threaded coupling rod (5) for locking engagement with said adjusting nut (9), said adjusting nut (9) having at least one recess (3) or projection (23) arranged approximately radially with respect to said threaded coupling rod (5) for locking engagement with said lock (15), and an eccentric cam (6) rigidly connected to said arm (20) for positively controlling displacement of said lock (15).

2. The arm bearing for an awning according to claim 1, wherein said eccentric cam (6) is formed on a beaded edge (11) of a cam plate (7), and said lock (15) has a groove (10) engaging with said beaded edge (11).

3. The arm bearing for an awning according to claim 1, further comprising a rotation preventer (12, 25) for preventing rotation of said adjusting nut (9).

4. The arm bearing for an awning according to claim 3, wherein said rotation preventer comprises a spring clip (12) and a stop wall (25) located inside of said at least one limb (21).

5. The arm bearing for an awning according to claim 4, wherein said spring clip (12) is held on said first rotation axle (13).

6. The arm bearing for an awning according to claim 4, wherein said rotation preventer comprises a chain or wire.

7. The arm bearing for an awning according to claim 1, further comprising:

a hollow mounting tube (1) having a sliding block (17) arranged to slide therein, wherein said at least one support block (2) comprises two parts fixed to said sliding block (17) by screws (16), each of said two parts being prevented from rotating by a groove (26) cooperating with a spring (27) connected to said hollow mounting tube (1).

8. The arm bearing for an awning according to claim 1, wherein said lock (15) is arranged to penetrate between 5 to 10 mm. into said at least one recess (3) in said adjusting nut (9).

9. The arm bearing for an awning according to claim 1, wherein said adjusting nut (9) and said lock (15) are made of hardened steel.

10. The arm bearing for an awning according to claim 1, wherein said lock (15) has a conical contact surface for engagement with an approximately complementary surface on said adjusting nut (9).

11. The arm bearing for an awning according to claim 1, wherein said lock (15) comprises at least two pins (24*a*, 24*b*, 24*c*, 24*d*) arranged to engage with at least two recesses spaced apart at each side of said adjusting nut (9).

12. The arm bearing for an awning according to claim 11, wherein at least one of said lock (15), said at least two pins (24*a*, 24*b*, 24*c*, 24*d*), said at least two recesses (3) and said adjusting nut (9) has an approximately cylindrical shape.

13. The arm bearing for an awning according to claim 1, further comprising a toothed gear (18) having a gear input shaft (19) connected to a rotary drive for position-adjusting said threaded coupling rod (5) relative to said adjusting nut (9) by remote control, said threaded coupling rod (5) being connected to said toothed gear (18) at an end of said threaded coupling rod (5) facing away from said adjusting nut (9).

14. An arm bearing for an awning, comprising:

at least one support block (2), at least one bearing block (4) arranged to swivel about a first rotation axle (13) into a drop-out position, an arm (20) rotatable about a second rotation axle (14) transversely to said first rotation axle (13), a threaded coupling rod (5) coupling said support block (2) and said bearing block (4) for tilting movement of said bearing block (4), an adjusting nut (9) coupled to said threaded coupling rod (5) for limiting said tilting movement of said bearing block (4) within variable limits, at least one lock (15) coupled to said arm (20) and displaceable transversely to said threaded coupling rod (5) for locking engagement with said adjusting nut (9), said adjusting nut (9) having at least one recess (3) or projection (23) arranged approximately radially with respect to said threaded coupling rod (5) for locking engagement with said lock (15), and an eccentric cam (6) rigidly connected to said arm (20) for positively controlling displacement of said lock (15), wherein:

said at least one bearing block (4) is u-shaped, and receives said threaded coupling rod (5) between limbs (21) of said u-shaped bearing block (4), and at least one of said limbs (21) has a through-hole aligned with said recess (3) in a locking position to guide said lock (15) into locking engagement with said adjusting nut (9).

* * * * *